United States Patent [19]

Watts

[11] Patent Number: 4,825,769

[45] Date of Patent: May 2, 1989

[54] RAIL ASSEMBLY FOR USE IN A RADIOACTIVE ENVIRONMENT

[75] Inventor: Ralph E. Watts, Harrison, Ohio

[73] Assignee: The United States of America as represented by the United States Department of Energy, Washington, D.C.

[21] Appl. No.: 79,303

[22] Filed: Jul. 29, 1987

[51] Int. Cl.[4] ..... E01B 25/22; G21C 19/00

[52] U.S. Cl. ..... 104/107; 104/94; 238/310; 212/205; 376/260

[58] Field of Search ..... 376/260, 271, 268, 264, 376/261, 463; 104/106, 107, 108, 94; 212/140, 142.1, 205; 238/310, 315

[56] References Cited

U.S. PATENT DOCUMENTS

| | | | |
|---|---|---|---|
| 3,086,478 | 4/1963 | Schreyer | 104/108 |
| 3,580,183 | 5/1971 | Nearman | 104/108 |
| 3,637,096 | 12/1972 | Crate | 376/264 |
| 4,207,821 | 6/1980 | Beckert | 104/106 |
| 4,593,201 | 6/1986 | Gembus | 376/264 |
| 4,664,873 | 5/1987 | Hendrich et al. | 376/260 |

*Primary Examiner*—Deborah L. Kyle
*Assistant Examiner*—Daniel Wasil

[57] ABSTRACT

An improved rail assembly and method of construction thereof is disclosed herein that is particularly adapted for use with a crane trolley in a hot cell environment which is exposed to airborne and liquidborne radioactive contaminants. The rail assembly is generally comprised of a support wall having an elongated, rail-housing recess having a floor, side wall and ceiling. The floor of the recess is defined at least in part by the load-bearing surface of a rail, and is substantially flat, level and crevice-free to facilitate the drainage of liquids out of the recess. The ceiling of the recess overhangs and thereby captures trolley wheels within the recess to prevent them from becoming dislodged from the recess during a seismic disturbance. Finally, the interior of the recess includes a power track having a slot for receiving a sliding electrical connector from the crane trolley. The power track is mounted in an upper corner of the recess with its connector-receiving groove oriented downwardly to facilitate the drainage of liquidborne contaminants and to discourage the collection of airborne contaminants within the track.

23 Claims, 3 Drawing Sheets

RAIL ASSEMBLY FOR USE IN A RADIOACTIVE ENVIRONMENT

BACKGROUND OF THE INVENTION

This invention was made or conceived in the performance of contract number DE-AC06-84-RL-10436 with the U.S. Departmentof Energy.

This invention relates to an improved rail assembly for use with a bridge crane in a radioactive environment, such as a "hot cell" from where nuclear fuel assemblies are repaired or reconstituted.

Nuclear waste disposal facilities typically have special rooms, known as "hot cells", where the radioactive fuel in the fuel rods of used nuclear fuel assemblies may be reprocessed. Such hot cells typically include bridge-type cranes for lifting the long, rectangular fuel assemblies out of shipping casks and lowering them onto special work areas, where workers manipulae individual fuel rods with robotic arms visually monitored through lead-shielded glass.

The bridge cranes used in such hot cells are similar in many respects to conventional bridge cranes that are capable of moving a cable and hook along both an X-axis and a Y-axis. Specifically, such cranes include a first electrically operated trolley chassis that carries the hook and cable and whose wheels ride upon a pair of parallel, beam-type rails in an X-axis direction. The beam-type rails are orthogonally disposed over a pair of mutually opposing support walls oriented in a Y-axis direction. The ends of the parallel beam-type rails are inn turn mounted onto second and third trolleys, each of which rides upon a rail assembly mounted along the crown of one of the mutually opposing support walls. The X-axis movement of the cable and hook of the crane afforded by the first trolley over the beam-type rails, and the Y-axis movement of the beam-type rails afforded by the second and third trolleys over the opposing support walls allows the crane hook to be positioned over any desired point on the floor of the cell.

Each wall-type rail assembly is generally formed by a rail having an I-shaped cross-section which is mounted on the floor of an L-shaped recess in the upper portion of its respective wall. A power track is mounted on the side wall of each L-shaped recess parallel to the I-beam-shaped rail. Each trolley chassis includes an electrical connector which slidably fits into a slot in the power track. To prevent the trolleys from falling off their respective rails during a seismic disturbance, each trolley chassis includes angular brackets which capture the underside of the load-bearing top flange of its respective Ishaped rail.

While such prior art bridge cranes satisfactorily perform their intended mechanical function of lifting, moving, and lowering the heavy fuel assemblies to desired positions within within the hot cell, the applicant has observed that the mechanical configuration of the rail assemblies used in such prior art cranes creates significant problems whenever the hot cell is periodically subjected to a decontamination procedure. Such decontamination of the hot cell becomes necessary as a result of the inadvertent release of fine, highly radioactive particles in the air of the cell due to the rupture or breakage of a fuel rod. Such dust-like, airborne particles of radioactive fuel render the radiation level in the hot cell unacceptably high. The decontamination is carried out by spraying all the surfaces within the hot cell with a decontamination liquid which chemically captures and rinses away the radioactive elements present in the dust-like particles of fuel.

However, the many crevice regions inherent in the prior art rail assemblies provide many areas for the dust-like particles of nuclear fuel to collect which are difficult to spray directly with such a decontamination liquid. Some particularly difficult regions to decontaminate include the areas between the rails and the sides of the L-shaped recesses which house them, the regions between the angular, seismicclamp brackets and the upper flange of the rails, and the interior of the power tracks. Even when these areas are sprayed directly with decontamination liquid, they provide numerous "crud traps" where small puddles of the liquid can accumulate and eventually evaporate, thereby leaving deposits of concentrated radioactive material.

Still another deficiency of such prior art assemblies is the fact that they are relatively difficult to construct. In such assemblies, the I-beam shaped rail is mounted over the top surface of a bed plate that is cast in place on the floor of the L-shaped recess when the concrete that forms the upper portion of the wall is poured. Experience has shown that it is very difficult to maintain the top surface of the rail-supporting bed plate both flat and level as the concrete forming upper portion of the wall is poured. Any resulting irregularities interfere with the crane trolley's ability to smoothly travel along the rail during operation. These effects become more serious when very heavy loads are carried and handled by the crane.

Clearly, what is needed is an improved rail assembly for use with the trolley of a bridge crane which provides a minimum number of "crud traps" for airborne or liquidborne radioactive contaminants to collect and settle. Ideally, such a rail assembly should provide a means for positively maintaining the wheels of the trolley over the load-bearing surfaces of the rails even in the event of a seismic disturbance or other natural catastrophe. The load-bearing bed of such a rail assembly should be simple and easy to manufacture flat and level within small tolerances. Finally, the design of the improved rail assembly should be compatible with any commercially available trolley chassis to avoid the necessity of expensive, custom-made components.

SUMMARY OF THE INVENTION

Generally, the invention is an improved rail assembly and method for construction thereof for use with a bridge crane that operates in a radioactive environment which is easy both to construct and to decontaminate. The rail-assembly comprises a support wall, and an elongated, rail housing recess in said wall structure having a floor that is defined at least in part by the load-bearing surface of a rail. The floor is substantially flat, level, and crevice-free to facilitate the drainage of liquids out of the recess. The rail-housing recess may further include an overhanging portion that defines a ceiling which captures and thereby secures any trolley wheels against disengagement from the rails in the event of a seismic disturbance. In the preferred embodiment, the recess has a C-shaped cross-section rather than the L-shaped cross-section associated with the prior art.

The C-shaped recess may include a power track means having a slot along its longitudinal axis for receiving a sliding electrical connector from the trolley chassis. To facilitate the drainage of liquidborne contaminants, the power track means is preferably mounted in the recess above the recess floor with its connector-receiving slot oriented downwardly. In the preferred embodiment, the C-shaped recess is lined with a corrosion-resistant material, such as stainless steel. Moreover, the rail is supported within the wall by a matrix formed from a plurality of reinforcing members and a moldable construction material, such as concrete. The reinforcing members may be directly connected to the rail, and serve to support and properly position the rail during the pouring of the moldable construction material over the support members.

In the method of the invention, the reinforcing members are first secured in a base portion of the support wall. Next, an angular rail having a load-bearing flange is placed along the base portion of the support wall and connected to the reinforcing members in order to secure it in a desired position over the base portion with its load-bearing flange oriented flat and level. A moldable construction material such as concrete is then poured over the rail and reinforcing members to form a supporting matrix therearound. However, before the moldable construction material hardens, it is substantially leveled off with the load-bearing surface of the rail in order to form a flat, level, and crevice-free floor for the recess.

In the final steps of the method of the invention, a form fabricated from stainless steel sheet material and having a C-shaped cross-section is secured onto the base portion of the wall, and an additional amount of moldable construction material is poured around the outside of the sheet material to fabricate both the side wall of the recess, and an overhanging portion that defines a wheel-capturing ceiling which secures the trolley wheels over the rail in the event of a seismic disturbance. Preferably, this same stainless-steel form is left in the recess so as to provide corrosion-resistant sheathing around the ceiling and side wall thereof. Finally, the power track of the assembly is secured in the upper corner of the C-shaped recess with its connector-receiving slot oriented downwardly to facilitate the drainage of any decontamination liquid sprayed therein.

BRIEF DESCRIPTION OF THE SEVERAL FIGURES

DETAILED DESCRIPTION OF THE PREFERRED EMBODIMENT

Figure 1:
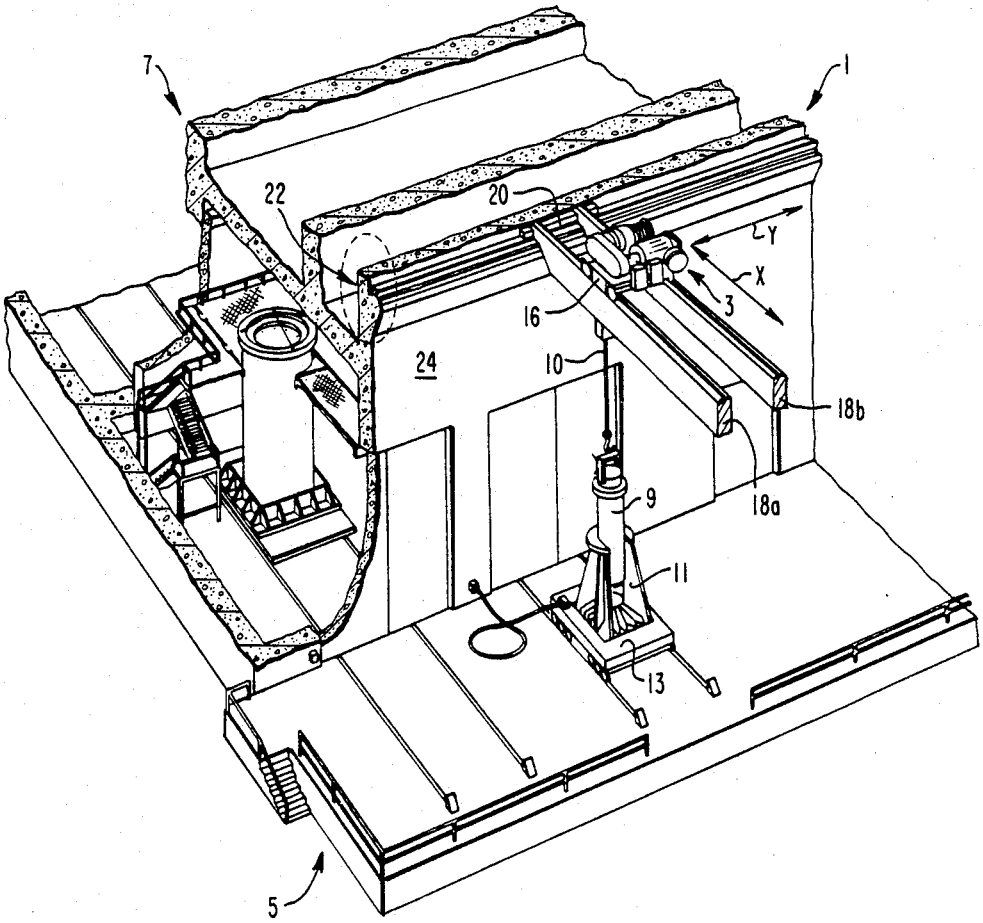
FIG. 1 is a perspective view of a fuel storage and salvaging facility, illustrating a prior art rail assembly used in connection with a bridge crane mounted over a hot cell.
Figure 2:
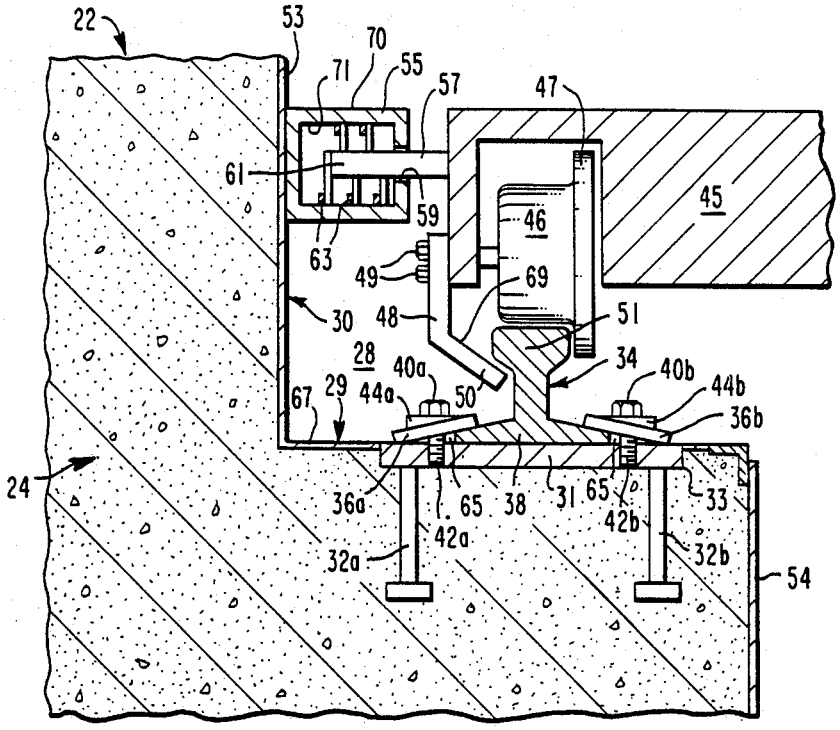
FIG. 2 PRIOR ART
FIG. 2 is an enlarged, cross-sectional side view of the wall-type rail assembly circled in FIG. 1.

With reference now to FIGS. 1 and 2, wherein like figures designate like components throughout all the several figures, the invention is an improvement of the rail assembly 1 used in connection with a bridge or trolley-type crane 3 in a hot cell 5 of a fuel storage and salvaging facility 7. Such bridge cranes 3 typically have a lifting capability of 150 tons, and are used to lift and lower shipping casks 9 containing spent nuclear fuel assemblies (not shown) that were used to heat the water in the primary side of a nuclear steam generator. FIG. 1 specifically shows a shipping cask 9 being lowered via the cable and hook 10 of the bridge crane 3 into a cask adapter 11 situated on top of a mobile cart 13.

The bridge crane 3 includes both a beam trolley 16, which serves to move the cable and hook 10 along a pair of parallel, beam-type rail assemblies **18*a*, 18*b* oriented along an X-axis, as well as a pair of wall trolleys 20 (only one of which is shown) that move both the beam trolley 16 and the beam-type rail assemblies 18*a*, 18*b* along a pair of wall-type rail assemblies 22 oriented along a Y-axis. The X-axis movement of the cable and hook 10 afforded by the beam trolley 16 along the beam-type rail assemblies 18*a*, 18*b* coupled with the Y-axis movement afforded the cable and hook 10 along the wall 24 by the wall trolleys 20 allow the operator of the bridge crane 3 to position the cable and hook 10 over practically any desired point of the floor 26 of the hot cell 5**.

FIG. 2 illustrates in greater detail the prior art wall-type rail assembly 22 shown in FIG. 1. Such wall-type rail assemblies 22 include an L-shaped recess 28 provided along the top edge of the wall 24 which has a floor 29, and an orthogonal side wall 30. A rectangular stainless steel bed plate 31 is usually cast in place in the floor 29 of the recess 28 when the top of the concrete wall 24 is poured. To securely anchor the bed plate 31 in place within the concrete wall 24, a plurality of anchors in the form of Nelson studs **32*a*, 32*b* are tack welded to the bottom of the bed plate 31 every six inches or so. These studs 32*a*, 32*b* are immersed in concrete when the top portion of the wall 24 in poured, as is the bottom portion of the bed plate 31. When the concrete forming the top portion of the wall 24 hardens, these studs 32*a*, 32*b* effectively secure the bed plate 31 into a complementary rectangular cavity 33 located beneath the floor 29 of the recess 28. A standard No. 80 rail 34 having a generally I-shaped cross section is mounted over the top surface of the bed plate 31 by canted clamp plates 36*a*, 36*b* which capture the lower flange 38 of the rail 34. Each of these clamp plates 36*a*, 36*b* is secured in place by nuts 40*a*, 40*b* that are threadedly engaged onto studs 42*a*, 42*b* screwed into tapped holes in the bed plate 31. Wedge-shaped washers 44*a* and 44*b* ensure that the nuts 40*a*, 40*b* apply a uniform clamping force over the top surfaces of the canted clamp plates 36*a* and 36*b***.

In operation, the wheels 46 of the chassis 45 of the wall trolley 20 roll over the top surface of the rail 34 as shown. Each of these wheels is cast steel and is circumscribed by an annular flange 47 which cooperates with the inner edge of the rail flange 51 to guide the wheel 46 over the rail 34. To ensure that the wheels 46 of the wall trolley 20 will not become disengaged from the rail 34 in the event of a seismic disturbance, a seismic clamp in the form of an angular bracket 48 is connected along the outer edge of the trolley chassis 45 by means of mounting bolts 49. The distal end 50 of the angular bracket 48 captures the underside of the top flange 51 of the rail 34. Such brackets 48 are also mounted along the opposite edge of the opposing wall trolley (not shown) in order to positively secure the wheels 46 of the trolley chassis 45 onto the rails 34.

The floor 29 and side wall 30 of the L-shaped recess 28 is provided with a coating 53 of an epoxy compound, while the top portion of the wall adjacent to the recess 28 is clad with a sheet of stainless steel 54. The epoxy coating 53 within the recess 28 and stainless steel cladding 54 along the top portion of the wall 24 facilitates the cleaning of this region of the hot cell 5 in the event that decontamination is necessary by providing a smooth, non-absorbent surface. The wall trolley 20 is powered by means of a power track 55 that receives a slidable electrical connector 57 which extends out from the edge of the trolley 20 as shown. The electrical connector 57 is received within a lateral slot 59 in the track 55, and has a plurality of electrically conductive spring fingers 61 which engage ridge-shaped connectors 63 within the power track 55, each of which transmits a different phase or control signal during the operation of the wall trolley 20.

As has been previously indicated, there are two major shortcomings associated with the prior art, wall-type rail assembly 22 illustrated in FIG. 2. First, during the construction of this particular assembly 22, it is very difficult to maintain the bed plate 31 flat and level while casting it in place along with the entire upper portion of the wall 24. Further complicating this particular operation is the fact that the bed plate 31 of rail assembly 22 must be completely parallel with the bed plate 31 of the opposing rail assembly (not shown) on the opposite wall. Any departures from a level orientation of the plate 30 will result in the application of spurious gravitational forces on the wall trolley 20 which in turn will impair its smoothness of operation. If these departures go beyond certain tolerances, the entire upper portion of the wall 24 may have to be chiseled out and re-cast. A second shortcoming associated with such prior art rail assemblies 22 is their tendency to collect airborne radioactive contaminants in their various crevice regions, thereby rendering it difficult, if not impossible, to completely flush and rinse these contaminants out of the rail assembly 22 during a decontamination operation. Such contaminant-collecting crevice regions include the spaces 65 between the clamp plates **36*a*, 36*b* and the lower flange 39 of the rail 34, the section 67 of the floor 29 of the recess 28 between the side wall 30 and the rail 34, the upper face 69 of the angular bracket 48 that serves as a seismic clamp, the upper surface 70 of the power track 55 and the interior 71 of the power track 55. Airborne, dust-like contaminants can settle in these crevice regions and thereby become inaccessible to a direct spray of decontaminatin liquid. During the decontamination process, some of the particulate contaminants become liquidborne as a result of their contact with the liquid decontamination solution. Such liquidborne contaminants can collect in any of these crevice regions, and form "hot spots" in the rail assembly 22** when the liquid evaporates.

Figure 3:
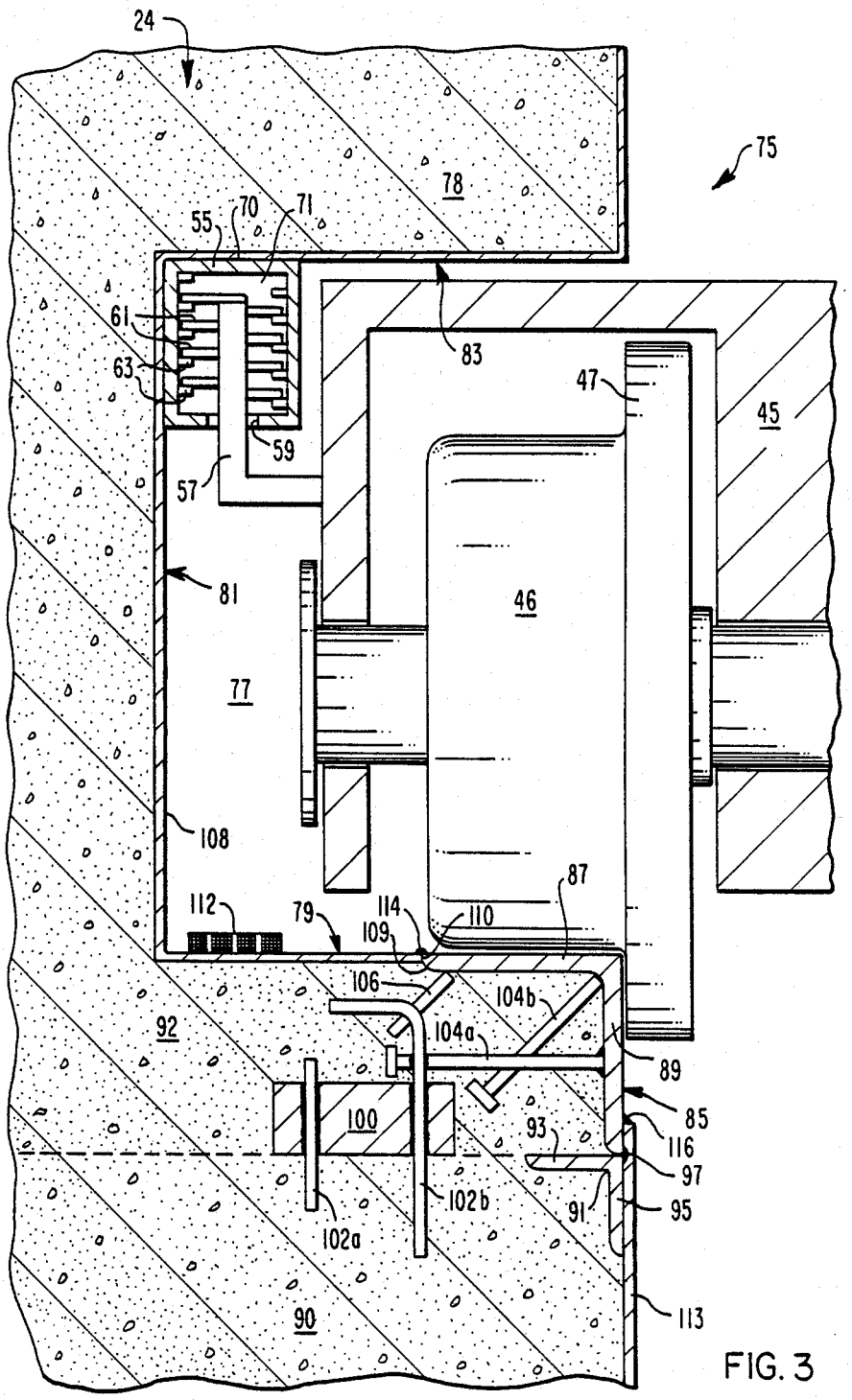
FIG. 3 is a cross-sectional side view of a first embodiment of the improved wall-type rail assembly of the invention.

With reference now to FIG. 3, the improved wall rail assembly 75 of the invention includes a recess 77 having an overhanging portion 78, as well as a floor 79 and a side wall 81. The provision of the overhanging portion 78 results in a recess 77 having a C-shaped cross section that includes a ceiling 83, in contrast to the prior art recess 28 having an L-shaped cross section comprised of only a floor 29 and side wall 30. In the preferred embodiment, the overhanging portion 78 is dimensioned so that the resulting ceiling 83 is closely spaced over the top of the chassis 45 of the wall trolley 20, thereby effectively capturing the chassis 45 and wheels 46 within the improved recess 77. Such a structure obviates the need for angular brackets 48 or other forms of seismic clamps to hold the wheels 46 of chassis 45 over the rail 85 of the rail assembly 75 in the event of a seismic disturbance.

The rail 85 of the improved wall rail assembly 75 is preferably an angular piece of stainless steel having a load-bearing flange 87 that is level with the floor 79 of the recess 77, and a guide flange 89 that is parallel with the side of the wall 24. The top surface of the load-bearing flange 87 bears the weight of the trolley chassis 45 through the wheels 46, while the guide flange 89 coacts with the annular flanges 47 on the wheels 46 in order to help guide the same. In the particular embodiment of the invention illustrated in FIG. 3, the top surface of the load-bearing flange 87 is co-planar with the rest of the floor 79 of the C-shaped recess 77, which eliminates the previously referred to contaminant-collecting crevice 67 associated with the prior art rail assembly 22 illustrated in FIG. 2. The end result of the FIG. 3 rail assembly design is a floor 79 which is flat, level, crevice-free and completely accessible to a direct spray of a decontamination liquid over all its area.

Imbedded in the base portion 90 of the concrete wall 24 just below the rail 85 is a right angular guide rail 91. The upper flange 93 of the guide rail 91 is preferably oriented level, while the side flange 85 is oriented parallel to the side of the wall 24. As will be discussed in more detail hereinafter, the principal purpose of the guide rail 91 is to provide a guide for the rail 85 during the pouring of the top of the wall over base portion 90 which helps maintain the load-bearing flange 87 both flat and level. The lower edge of the guide flange 89 of the rail 85 is affixed to the upper edge of the side flange 95 of the guide rail 91 by means of a weld bead 97 as shown.

The improved rail assembly 75 further includes a reinforcing bar 100. Bar 100 is imbedded in the concrete immediately below the floor 79 of the recess 77 but above base portion 90 to reinforce the concrete layer 92 supporting the load-bearing flange 87 of rail 85. The reinforcing bar 100 includes a plurality of wire posts **102*a*, 102*b* distributed all along its length, which structurally reinforces the concrete in this area and helps prevent it from cracking or chipping. These wire posts 102*a*, 102*b* are directly connected to the interior of the angular rail 85 by means of a plurality of Nelson studs 104*a*, 104*b* and straps 106. The interconnection between the rail 85 and the wire posts 102*a*, 102*b* not only helps the reinforcing bar 100 to lend support to the rail 85 within the concrete matrix surrounding the bar 100 and the interior of the rail 85, but also serves to support the rail 85 in a flat and level position when the concrete that forms the floor 79** of the recess is poured.

A power track 55 is disposed in the upper left hand corner of the recess 77 as shown. Like the previously described power track, track 55 receives an electrical connector 57 mounted on a chassis 45 of the trolley 20 through a slot 59. This slidable electrical connector 57 includes a plurality of fingers 61 which slidably engage ridge-shaped connectors 63 mounted in parallel within the interior of the power track 55. However, unlike the power track 55 shown in FIG. 2, the slot 59 is disposed downwardly so that liquidborne radioactive contaminants can easily drain out of the interior 71 of the track 55. Such an orientation of the slot 59 further discourages airborne radioactive contaminants from collecting within the track interior 71. A further difference between the power track 55 illustrated in FIG. 3 and the power track 55 illustrated in FIG. 2 is the fact that the upper surface 70 of the track 55 illustrated in FIG. 3 directly abuts the ceiling 83 of the recess 77. This abutment between the ceiling 83 of the recess 77 and the upper surface 70 of the power track 55 in the FIG. 3 embodiment of the invention has the effect of eliminating another one of the contaminant-collecting areas characteristic of prior art rail assemblies 22 of the type illustrated in FIG. 2.

As is evident from FIG. 3, the entire C-shaped cross section of the recess 77 of the improved wall rail assembly 75 is clad with a sheet 108 of stainless steel. In this preferred embodiment the lower edge 110 of the stainless steel sheet cladding 108 abuts and is formed level with the outer edge 109 of the load-bearing flange 87 of the rail 85, thereby providing a smooth, level and crevice-free floor 79 within the recess 77. A weld bead 114 preferably connects edge 110 of the cladding 108 with the edge 109 or the flange 87. If desired, a flat wire cable 112 may be disposed along the floor 79 of the recess 77. Such a cable 112 may be used to mechanically pull the chassis 45 of the wall trolley 75 in the event of an electrical failure. To complete the structure 75, the side of the wall 24 is clad with a sheet 113 of stainless steel.

Figure 4:
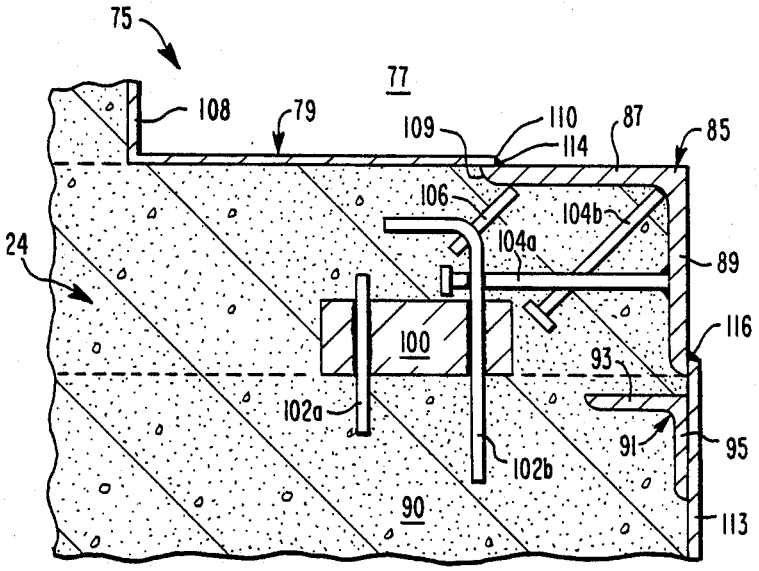
FIG. 4 is a partial cross-sectional side view of an alternate embodiment of this improved rail assembly.

FIG. 4 illustrates an alternative embodiment of the improved wall rail assembly 75. In this alternative embodiment, the load-bearing flange 87 of the rail 85 is situated flush with the concrete forming the floor 79 of the recess 77, instead of being flush with the stainless steel sheet cladding 108. While this particular configuration forms a small ridge in the floor 79 where the outer edge 110 of the stainless steel sheet cladding 108 overlaps the outer edge 109 of the load-bearing flange 87 of the rail 85, it is easier to install. Moreover, the small ridge caused by the overlapping of the cladding 108 of the edge of the flange 87 is not a crevice-forming structure. Indeed, this overlapping joint may be considerably smoothed out by the application of the weld bead 114 thereby rendering the floor 79 of the recess 77 substantially flat. It should be noted that the weld bead 114 not only joins the cladding 108 to the rail 85 in both embodiments, but further acts as a mositure barrier which prevents liquidborne radioactive contaminants from seeping under the cladding 108 and becoming absorbed in the concrete immediately therebelow.

In contrast to the prior art rail assembly illustrated in FIG. 2, the structure of the improved rail assembly 75 of the invention renders it easy to manufacture a wall rail that is flat, level and devoid of crevice regions. In the method of constructing the improved wall rail assembly 75, the support wall 24 is first poured up to the lower dotted line illustrated in FIG. 3 to form the base portion 90 of the wall 24. Before this concrete hardens, the reinforcing bar 100 is placed over the top of the concrete so that its wire posts 102*a*, 102*b* extend into the non-hardened concrete in the position illustrated in FIG. 3. Additionally, the guide rail 91 is placed in the position illustrates in FIG. 3 so that its upper flange 93 is substantially flat and level.

In the next step of the construction method, the rail 85 is placed into the position illustrated in FIG. 3 with its load-bearing flange 87 both flat and level. The rail 85 is then secured in this position by the installation of Nelson studs 104*a*, 104*b* and straps 106 which are tack welded between the wire posts 102*a*, 102*b* of the reinforcing bar 100, and the interior of the rail 85. In the FIG. 3 embodiment of the invention, the upper flange 93 of the guide rail 91 both guides and provides a place to secure the rail 85 in a proper position. A weld bead 97 is then applied between the lower edge of the guide flange 89 and the upper edge of the guide rail 91 to interconnect them. Weld bead 97 may be made intermittent, or continuous to form a back-up watertight joint that no decontamination liquid can leak into. By contrast, in the embodiment illustrated in FIG. 4, a small gap is allowed between the lower edge of the side flange 95 of the guide rail 91 and the guide flange 89 of the rail 85. Hence, the guide rail 91 functions neither to support the rail 85 or to secure it into its desired position. Instead, the positioning function is carried out exclusively by the Nelson studs 104*a*, 104*b* and straps 106. In both embodiments, before the concrete forming the top portion of the wall 24 is poured over the base portion, the upper edge of the stainless steel sheet cladding 113 applied over the side of the wall 24 is joined to the lower edge of the guide flange 89 of the rail 85 through a continuous weld bead 116 to form a watertight seal therebetween that the decontamination liquid cannot penetrate.

In the next step of the construction method, a layer 92 of concrete is poured over both the reinforcing bar 100 and the bottom side of the rail 85 up to the upper dotted line. The concrete in the layer 92 and the reinforcing bar 100, wire posts 102*a*, 102*b*, Nelson studs 104*a*, 104*b* and straps 106 create a strong supporting matrix beneath the load-bearing flange 87 of the rail 85 after the concrete hardens. The pouring of a relatively small layer of concrete 92 at this juncture makes it very easy to maintain the flange 87 both flat and level, and to create a floor 79 flor the recess 77 that is likewise flat and level. It should be noted that, in the FIG. 4 embodiment, the concrete forming the layer 92 is not poured completely flush with the upper surface of the load-bearing flange 87, but slightly lower to receive the bottom flange of the cladding 108.

In the last step of the construction method, the upper portion of the wall 24 that includes the recess 77 is constructed. This is preferably accomplished by bending the stainless steel sheet cladding 108 so that it has the exact C-shaped profile that is desired for the improved recess 77. Next, the cladding is placed into the position shown in FIG. 3 and its edge is welded to the edge 109 of the load-bearing flange 87 of the rail 85. Finally, the concrete is poured above and to the side of the cladding 108, which advantageously acts as a form that shapes the side wall 81 and overhanging portion 78 of the recess 77.

The method of construction in the FIG. 4 embodiment is essentially the same, the primary difference being that the concrete forming the floor 79 of the recess can be poured flush with the top surface of the load-bearing flange 87 instead of a fraction of an inch therebelow to accommodate the bottom flange of the cladding 108.

I claim:

1. An improved crevice-free rail assembly particularly adapted for use with an electrically operated crane trolley in an environment exposed to airborne and liquidborne radioactive contaminants, comprising a pair of opposing support walls, and an elongated rail-housing recess in each of said walls that has a floor and a ceiling, said floor being defined at least in part by the load-bearing surface of a rail, and each of said floors of said recesses being substantially flat, level and crevice-free to facilitate the drainage of liquids out of the recesses, said ceiling overhanging said wheels to capture and secure said wheels within said recess, and said rail being supported within said wall by a plurality of reinforcing members that are encased in a moldable construction material.

2. The improved rail assembly of claim 1, wherein each rail-housing recess receives at least two trolley wheels.

3. The improved rail assembly of claim 1, wherein one of said recesses includes a power track means having a slot along its longitudinal axis for receiving a sliding electrical connector from the crane trolley.

4. The improved rail assembly of claim 3, wherein said power track means is mounted in its respective rail-housing recess above the substantially flat and crevice-free floor.

5. The improved rail assembly of claim 4, wherein said slot is located at the bottom of said power track means to facilitate the drainage of liquidborne contaminants therefrom and to discourage the collection of airborne contaminants within said slot.

6. The improved rail assembly of claim 2, wherein the ceilings of said recesses are both substantially flat and level.

7. The improved rail assembly of claim 1, wherein each of said recesses is lined with a corrosion-resistant material.

8. An improved crevice-free rail assembly particularly adapted for use with a crane trolley in an environment exposed to airborne and liquidborne radioactive contaminants, comprising a support wall, and a rail-housing recess in said wall for receiving the wheel of a crane trolley, wherein said recess has a floor defined at least in part by the load-bearing surface of a rail which is substantially flat, level and crevice-free to faciliate the drainage of liquids out of the recess, and a ceiling that overhangs said wheel to capture and secure it within the recess in the event of seismic disturbance, wherein said rail is supported within said wall by a matrix that includes at least one reinforcing member that is encased in a moldable construction material, said member serving to secure said rail in a flat and level position when said moldable construction material is poured therearound.

9. The improved rail assembly of claim 8, wherein said recess includes a power track means having a slot along its longitudinal axis for receiving a sliding electrical connector from the crane trolley.

10. The improved rail assembly of claim 9, wherein the power track means is mounted in the rail-housing recess above its floor, and said slot is located along the bottom of said power track means to facilitate the drainage of liquidborne contaminants out of said power track means, and to discourage the accumulation of airborne contaminants in said track means.

11. The improved rail assembly of claim 8, wherein all but the load-bearing surface of said rail is substantially embedded in said matrix.

12. The improved rail assembly of claim 8, wherein the bottom of said matrix includes a guide rail for facilitating the positioning of said rail prior to the application of said moldable construction material over said reinforcing member and over all but the load-bearing surface of the rail.

13. The improved rail assembly of claim 10, wherein said recess includes a side wall, and said power track means is mounted in the corner of the recess defined by the junction of the side wall with the ceiling.

14. The improved rail assembly of claim 8, wherein said recess is lined with a corrosion-resistant material.

15. The improved rail assembly of claim 8, wherein the recess has a substantially rectangular cross section.

16. An improved rail assembly particularly adapted for use with a crane trolley in an environment exposed to airborne and liquidborne radioactive contaminants, comprising a pair of opposing support walls, each of which includes a rail-housing recess that receives opposing wheels of a crane trolley, and each of which has a floor and a ceiling, said floor being defined at least in part by the loadbearing surface of a rail and being substantially flat, level and crevice-free to facilitate the drainage of liquids out of the recess, said rail being supported within said wall by a matrix formed by at least one reinforcing member encased within a moldable construction material, said member serving both to secure said rail in a flat and level position when said moldable construction material is poured therearound, and to support said rail during use, and said ceiling overhanging said wheel to capture and secure said wheels within said recess, wherein said recess further includes a power track means mounted along a corner of the recess above the floor thereof to facilitate drainage of liquidborne contaminants, and to discourage the accumulation of airborne contaminants in said track means.

17. The improved rail assembly of claim 16, wherein said power track means includes a slot for receiving a sliding electrical connector from the crane trolley, and wherein said slot is oriented to facilitate drainage of liquidborne contaminants out of said power track means.

18. The improved rail assembly of claim 16, wherein all but the load-bearing surface of said rail is substantially embedded in said matrix.

19. The improved rail assembly of claim 18, wherein the bottom of said matrix includes a guide rail foro facilitating the positioning of said rail prior to the application of said moldable construction material over said reinforcing member and over all but the loadbearing surface of the rail.

20. The improved rail assembly of claim 16, wherein said recess is lined with a corrosion-resistant material.

21. The improved rail assembly of claim 16, wherein said recess includes a side wall which is substantially orthogonal to the floor.

22. The improved rail assembly of claim 16, wherein the recess has a substantially rectangular cross section.

23. The improved rail assembly of claim 16, wherein the recess has a substantially rectangular cross section.

* * * * *